United States Patent [19]

Anderson et al.

[11] Patent Number: 4,735,611

[45] Date of Patent: Apr. 5, 1988

[54] PROJECTILE SYRINGE FOR BLOWPIPE

[75] Inventors: Owen A. Anderson, Houston, Tex.; Lane S. McCutcheon, Fayette, Mo.

[73] Assignee: Midwest Sport Distributors, Inc., Fayette, Mo.

[21] Appl. No.: 31,419

[22] Filed: Mar. 30, 1987

[51] Int. Cl.[4] ..... A61M 5/20

[52] U.S. Cl. ..... 604/130; 604/272

[58] Field of Search ..... 604/130, 131, 132, 133, 604/134, 135, 136, 137, 274, 256, 272

[56] References Cited

U.S. PATENT DOCUMENTS

| | | | |
|---|---|---|---|
| 3,114,370 | 12/1963 | Kayler | 604/137 |
| 4,243,036 | 1/1981 | Ott | 604/130 |
| 4,537,593 | 8/1985 | Alchas | 604/274 X |
| 4,643,712 | 2/1987 | Kulik et al. | 604/256 X |

*Primary Examiner*—John D. Yasko

*Attorney, Agent, or Firm*—Hovey, Williams, Timmons & Collins

[57] ABSTRACT

An improved, projectible syringe is provided for the introduction of a fluid medicament or the like into an animal from a position remote from the animal. The syringe assembly includes a tubular syringe body having an internal, axially shiftable plunger and an elongated rod coupled with the latter; the plunger rod is used to withdraw the plunger and fill the syringe body with an injectible fluid. Structure is also provided for creating a biasing force against the plunger urging the same forwardly for injection purposes, along with apparatus for selectively restraining such forward plunger movement until the syringe assembly is used. In practice, a specialized injection needle having a transverse fluid outlet is provided, together with a shiftable fluid flow-blocking needle sleeve. When the syringe assembly is projected towards and through an animal's skin, the blocking sleeve is shifted, thereby exposing the needle aperture. The biasing force acting against the syringe plunger thereupon moves the plunger forwardly, injecting the fluid substance into the animal.

11 Claims, 3 Drawing Sheets

Fig. 1.
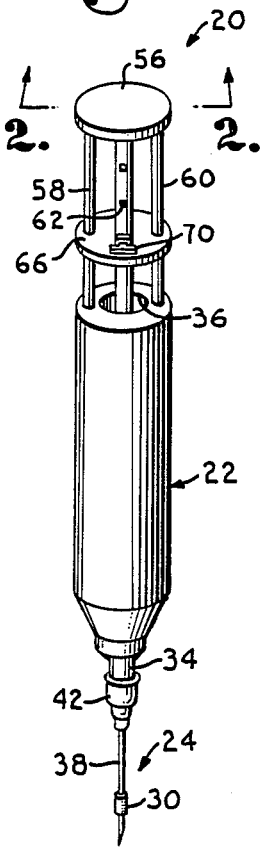
Fig. 2.
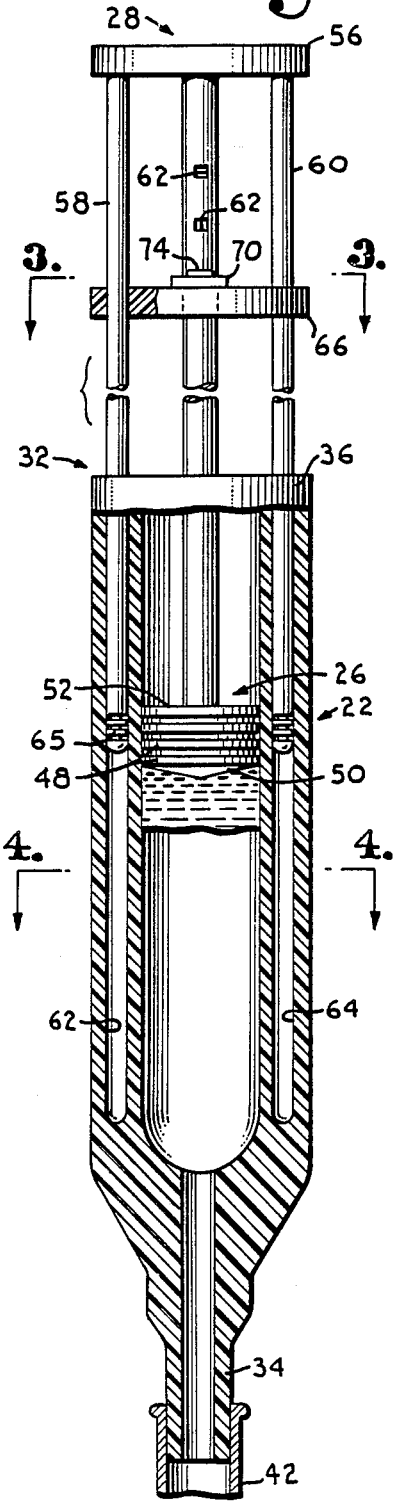
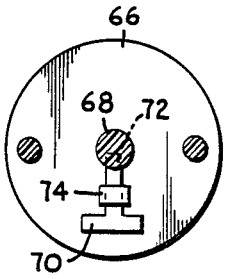
Fig. 3.
Fig. 5.
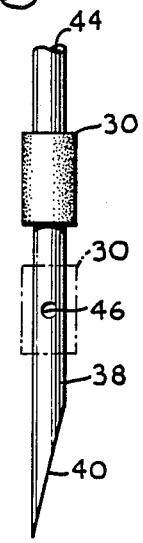
Fig. 4.
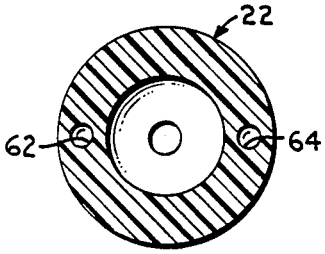

Fig. 6.
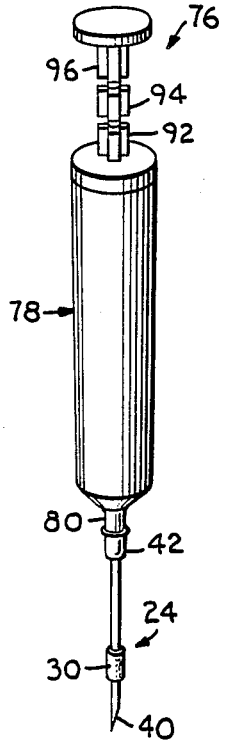
Fig. 7.
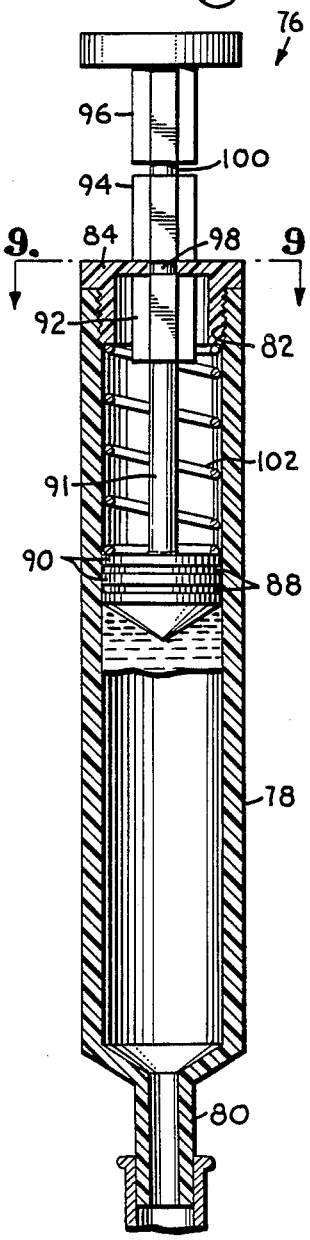
Fig. 8.
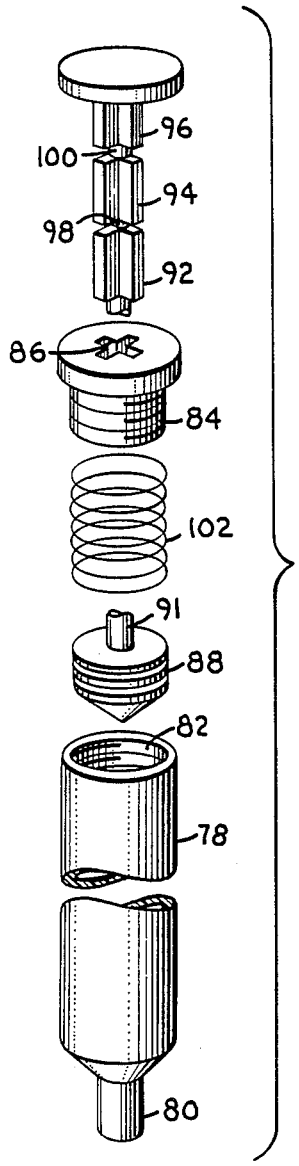
Fig. 9.
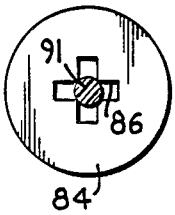
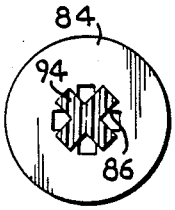
Fig. 10.

Fig.11.
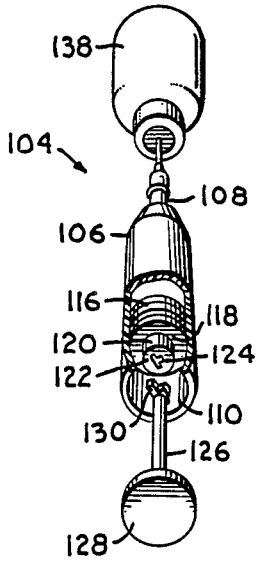
Fig.12.
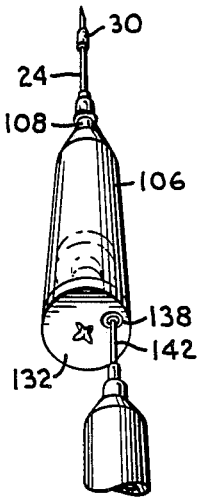
Fig.13.
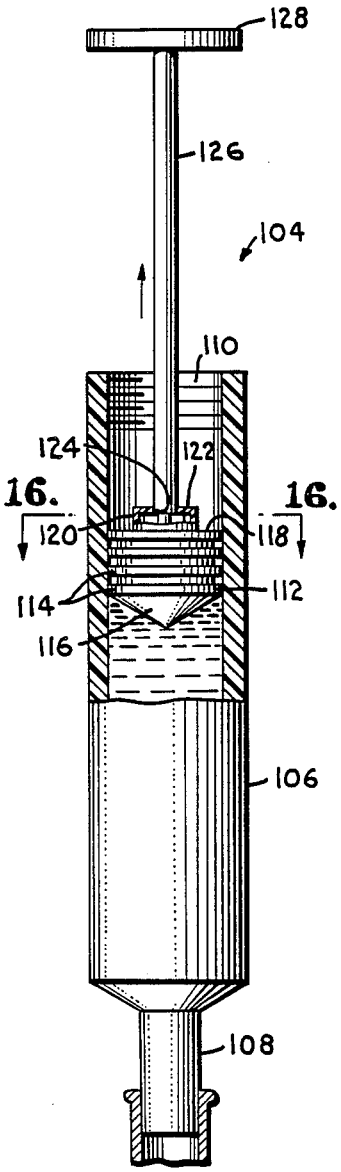
Fig.14.
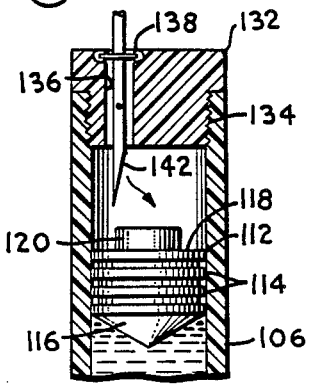
Fig.15.
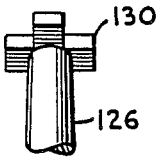
Fig.16.
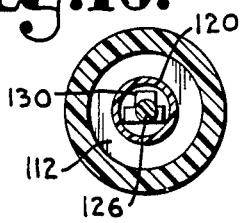
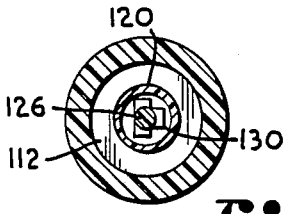
Fig.17.

PROJECTILE SYRINGE FOR BLOWPIPE

BACKGROUND OF THE INVENTION

1. Field of the Invention

The present invention is broadly concerned with an improved projectible syringe designed to facilitate the injection of sedatives or other medicaments into animals from a position remote from the animal. More particularly, it is concerned with such a projectible syringe which can be readily filled and manipulated by the user, whereupon, through the use of a blow gun or similar device, the device can be projected toward and into the skin of a subject animal, with the dose of medicaments thereupon being injected, all without the necessity of the user coming into close proximity to the animal.

2. Description of the Prior Art

Those involved in the care of large animals (e.g., zoo keepers and livestock handlers) often find it convenient to sedate such animals. This allows the user to approach and care for the animal without fear that the animal will become aroused and perhaps dangerous. By the same token, it is sometimes desired to directly inject medicament into animals from a remote position.

It has been known in the past to provide a system including an elongated blow pipe together with a projectible syringe for such purposes. The syringe in this prior system is designed so that the injection needle thereof will pierce the skin of the animal and medicament will be thereupon injected by virtue of a charge of pressurized air established in the syringe prior to fixing thereof. Such a system is commercialized as the "Maxi-ject Veterinary Blowpipe System", and the overall structure of the blowpipe and syringe is described in an instruction manual distributed by Addison Biological Laboratory, Inc. of Fayette, Missouri. This instruction manual is incorporated by reference herein.

Basically speaking, the Maxi-ject apparatus includes an elongated syringe body having a pair of shiftable plungers therein. An injection needle is also provided which is adapted to fit onto one end of the syringe body. This needle is of specialized construction in that it includes a transverse aperture spaced from the sharpened skin-piercing needle end thereof which is in communication with an axial fluid passageway. A shiftable silicon sleeve is positionable over this transverse aperture, so that, when the syringe is projected into the animal's skin, the sleeve is shifted away from the aperture. This in turn permits the dose to be injected from the syringe by virtue of a previously established pressurized charge of air behind the injection plunger.

In practice however, the "Maxi-ject" apparatus requires the use of a conventional syringe in order to withdraw sedative or other medicament from a vial thereof, whereupon this conventional syringe is connected via a specialized coupler to the projectible syringe body. The fluid in the conventional syringe is then injected into the projectible syringe. The next step involves attachment of the specialized needle and flow-blocking sleeve onto the projectible syringe, followed by connection of a conventional air-filled syringe to the remote end of the projectible syringe body and filling the latter with a charge of compressed air between the two plungers. A guidance tail is then placed on the rear end of the projectible syringe remote from the needle, so as to complete the assembly and make it ready for use with the blowpipe. As can be appreciated, this procedure is rather complicated and unwieldly, particularly inasmuch as it is often necessary to carry out the make ready steps in the field. Accordingly, there is a real need in the art for an improved projectible syringe which can be readily filled and used without complicated procedures or extraneous equipment.

SUMMARY OF THE INVENTION

The present invention overcomes the problems noted above and provides an improved projectible syringe designed for use with a blowpipe or similar device. The syringe includes a tubular syringe body for holding a dose of an injectible fluid substance, together with means for drawing a dose into the syringe body, maintaining the dose within the body during projection and flight of the syringe toward a subject animal, and for injection of the dose into the subject once the injection needle is lodged with the animal's skin.

In more detail, the projectible syringe of the invention includes an elongated injection needle affixable to the open end of the tubular body. This injection needle is of the known variety and presents a sharpened skin-piercing end and a tranversely extending projection aperture spaced from the sharpened end which communicates with an axial fluid passageway.

The overall syringe assembly further includes a plunger within the tubular body which is axially shiftable along the latter and presents peripheral sealing means and a pair of opposed faces. An elongated plunger rod is operatively coupled with the plunger and extends out of the rear end of the syringe body for permitting selective withdrawal of the plunger in order to withdraw a dose of the injectible substance into the syringe body.

Means is also provides for selectively restraining forward plunger movement to thereby maintain the fluid dose within the syringe body during fixing of the syringe. This restraining means includes a fluid flow-blocking member (such as a shiftable silicon sleeve) positionable in covering relationship over the transverse needle aperture and being shiftable away from the needle aperture upon encountering the skin of an animal.

Finally, the complete syringe assembly of the invention includes means for creating a biasing force against the face of the plunger remoted from the injection needle in order to impart forward movement of the plunger towards the needle to inject the dose. Such a biasing force can be created by a number of different structural arrangements, including a spring positioned within the syringe body and engageable with the face of the plunger remote from the injection needle. In this fashion, as a dose is drawn into the syringe body the spring is compressed. In order to prevent premature injection of the dose, temporary plunger locking means is provided. This advantageously comprises mechanical latching structure engageable with the plunger rod in order to hold the plunger rod in a retracted position until the injectible needle and its associated flow-blocking member are in place. At this point the flow-blocking member serves to restrain forward plunger movement, and the temporary latching structure is released. In alternative forms, the force-creating structure may comprise one or more secondary rods coupled and shiftable with the main plunger rod and received within corresponding vacuum chamber(s). The secondary rod carries sealing means engaging the walls of the secondary chamber so that, upon retraction of the secondary rods a partial vacuum is created within the secondary chamber. Here again, mechanical latching structure is employed to maintain the plunger and secondary rods in their retracted position until the specialized needle and flow-blocking member are in place. This latching structure is then released so that upon use of the projectible syringe when the flow-blocking member is shifted from the needle aperture, atmospheric air serves to push the plunger forwardly for injection purposes.

BRIEF DESCRIPTION OF THE DRAWINGS

FIG. 1 is a perspective view of a projectible syringe in accordance with the invention;

FIG. 2 is an enlarged view in partial vertical section taken along line 2—2 of FIG. 1 and illustrating the internal construction of the syringe assembly;

FIG. 3 is a sectional view taken along line 3—3 of FIG. 2;

FIG. 4 is a sectional view taken along 4—4 of FIG. 2;

FIG. 5 is a fragmentary view illustrating the construction of the specialized injection needle forming a part of the syringe assembly, with the shiftable flow-blocking sleeve situated on the needle;

FIG. 6 is a perspective view of another embodiment of a projectible syringe assembly in accordance with the invention.

FIG. 7 is an enlarged, fragmentary section view in partial vertical section illustrating the internal construction of the syringe assembly depicted in FIG. 6;

FIG. 8 is an exploded fragmentary view illustrating the construction of the syringe assembly of FIG. 6;

FIG. 9 is a sectional view taken along line 9—9 of FIG. 7;

FIG. 10 is a view similar to that of FIG. 9, but showing the non-circular plunger and cap opening and the mating cross sectional configuration section of the plunger rod, with the plunger rod being axially rotated to a locking position wherein the rod section is out of alignment with the cap opening;

FIG. 11 is a fragmentary perspective view illustrating another embodiment of the invention during filling operations with the syringe assembly;

FIG. 12 illustrates the syringe assembly of FIG. 11 during charging of the latter with pressurized air;

FIG. 13 is an enlarged view in partial vertical section illustrating the internal construction of the syringe assembly of FIG. 11;

FIG. 14 is an enlarged fragmentary view in partial vertical section illustrating the air charging of the syringe;

FIG. 15 is a fragmentary perspective view illustrating the releasable connection end of the plunger rod of the embodiment of FIG. 11;

FIG. 16 is a sectional view taken along line 16—16 of FIG. 13 and illustrating the plunger rod operatively coupled to the shiftable plunger; and FIG. 17 is a view similar to that of FIG. 16, but showing the plunger rod oriented for removal thereof from the plunger.

DESCRIPTION OF THE PREFERRED EMBODIMENTS

Turning now to the drawings, a projectible syringe assembly 20 is illustrated in FIGS. 1 and 2. Broadly speaking, the assembly 20 includes a tubular syringe body 22 adapted to hold a dose of fluid medicament or the like, a specialized injection needle 24 affixed to one end of the body 22, a shiftable plunger 26 situated within the body 22 and having a elongated plunger rod 28 affixed thereto and extending out of the rearward end of the body. Means is also provided for selectively restraining forward plunger movement, such including a shiftable flow-blocking sleeve 30 mounted on needle 24. Finally, means 32 is provided for creating a biasing force against the plunger serving to move the latter forwardly to thereby inject a fluid substance into an animal.

In more detail, the syringe body 20 is in the form of an elongated, circular in cross section tube presenting a reduced diameter open injection end 34 together with an opposed plunger end 36. The body is conventionally marked with appropriate volume indicators and is typically formed of a synthetic resin material.

The needle 24 is adapted to be affixed to injection end 34 of syringe body 22. The needle 24 includes an elongated metallic shank 38 having a sharpened skin-piercing end 40 and a radially enlarged, tubular, cup-like member 42 designed to fit over and mate with open injection end 34 of body 22. In addition, the shank 38 is provided with an elongated, axially extending fluid flow passageway 44 which terminates in a transversely extending injection aperture 46. It will be noted in this regard that, as contrasted with conventional syringe needles, the aperture 46 is spaced from the sharpened end 40 of the needle 24. The importance of this feature will be explained hereinafter.

The plunger 26 is in the form of a disc-like elastomeric body presenting a plurality of peripheral sealing ribs 48 designed to engage the inner surface of the sidewall of body 22. In addition, the plunger has a somewhat conical forward face 50 together with an opposed rearward face 52. Plunger rod 26 in this embodiment comprises an elongated, central rod 54 permanently affixed to plunger 26 and extending out end 36 of the body 22. The outermost end of rod 54 is in the form of a transversely extending cap 56 which also supports a pair of laterally spaced apart elongated secondary rods 58, 60, the importance of which will be explained hereinafter. It should further be noted that the rod 54 is provided with a plurality of axially spaced apart detents 62 along the upper end thereof, and here again the importance of this feature will be explained below.

The overall syringe body 22 is further provided with a pair of elongated, axially extending secondary chambers 62, 64 respectively within the defining sidewall of the syringe body. These secondary chambers in turn receive the corresponding secondary rods 58, 60 as will be readily apparent from a study of FIG. 2. Each of the rods 58, 60 further is provided with terminal seals 64, 65 serving to establish a fluid tight seal between the rods and the defining surfaces of the secondary chambers during reciprocation of the rods.

The rods 58, 60 carry a latching plate 66 situated between end 36 of body 22 and cap 56. This plate 66 is provided with a central aperture 68 which slidably receives plunger rod 54. In addition, the plate 68 includes a somewhat T-shaped stop 70 having an inner locking end 72. The shank of stop 70 is shiftable within a U-shaped guide 74. It will be noted in this respect that the locking end 72 is designed for insertion into the respective detents 62 provided in rod 54.

In the use of assembly 20, a conventional hypodermic needle (not shown) is temporarily affixed to end 34 of syringe body 22. This temporary needle is used to fill the body 22 with a dose of fluid medicament or the like, through the simple expedient of inserting the needle into a vial of medicament and withdrawing plunger rod 54 so as to draw the dose into the syringe body. At this point the stop 70 is manipulated so as to engage end 72 with one of the detents 62, thereby locking the plunger in its retracted position and preventing forward movement thereof which would serve to prematurely expel the fluid from the syringe body. It will further be noted that during this filling step, the secondary rods 58, 60 are simultaneously withdrawn within their corresponding chambers 62, 64. This serves to establish partial vacuum conditions within these chambers which, absent the aforementioned locking structure, would cause the plunger 54 to move forwardly upon release of the plunger rod.

The next step involves removal of the temporary hypodermic needle from end 34, and placing thereon the specialized injection needle 24. Sleeve 30 is moved to the position shown in phantom in FIG. 5, i.e., in covering relationship to aperture 46, so as to prevent flow of medicament out of syringe body 22. At this point the stop 70 can be withdrawn from the associated rod detent 62.

In this condition the assembly 20 is ready to be used as a projectible syringe. This typically involves placement of the loaded syringe assembly into a blowpipe which can be used in the known fashion to project the entire syringe assembly toward a subject animal. As the sharpened end 40 of needle 24 enters the animal's skin, sleeve 30 is encountered and moved upwardly as viewed in FIG. 5 to a point where aperture 46 is no longer covered. By virtue of the partial vacuum conditions created within the chambers 62, 64 as explained above, atmospheric pressure acting on cap 56 shifts plunger 54 forwardly thereby injecting the charge of fluid medicament into the animal.

FIGS. 6–10 illustrate another syringe assembly 76 in accordance with the invention. Here again, the assembly 76 includes a tubular syringe body 78 presenting an open injection end 80 and an opposed plunger end 82. In this instance, however, an end cap 84 is affixed as by threading to end 82 of the syringe body. The cap 84 is provided with a non-circular opening therethrough, in this instance a cross-shaped opening 86.

A plunger 88 is situated within body 78 as illustrated, and includes peripheral sealing ribs 90. An elongated plunger rod 91 is permanently affixed to plunger 88 and extends out end 82 of the body 78. In this respect, it will be noted that the plunger rod includes a plurality of elongated sections 92, 94 and 96 each having a cross sectional configuration mated to that of opening 86, i.e., in this instance cross-shaped. The remainder of the plunger rod between plunger 88 and lowermost section 92, and the zones 98, 100, separating the 3 zones 92, 96, are of circular configuration and have a diameter permitting passage thereof through the non-circular opening 86. Finally, it will be seen that each of the zones 98, 100, has an axial length slightly greater than the thickness of the top wall of cap 84.

A helical spring 102 is located within body 78 between the plunger 88 and cap 84. The spring is sized so that upon withdrawal of the plunger rod 91 the spring will be compressed.

The injection needle forming a part of assembly 76 is identical to that described in connection with the first embodiment and accordingly like reference numerals have been applied thereto.

The use of syringe assembly 76 is in most respects identical to that described with reference to assembly 20. That is to say, in the first place a conventional hypodermic needle is applied to end 80, whereupon the needle is inserted into a vial of fluid medicament. The plunger rod 91 is then withdrawn, which draws medicament into chamber 78. Simultaneously, this rod movement causes spring 102 to compress. At an appropriate point corresponding to the desired dosage to be injected, one of the reduced diameter zones 98, 100 aligns with the top wall of end cap 84. In order to temporarily lock the rod 91 in its retracted position against the bias of spring 102, the rod is axially rotated so that the adjacent cross-shaped section 94 or 96 is moved out of alignment with the cross-shaped opening 86. This condition is illustrated in FIG. 10.

The next step in the procedure involves replacement of the conventional hypodermic needle with the needle 34, the latter having sleeve 30 in flow-blocking position. Plunger rod 91 is then rotated so that the adjacent cross-shaped section 94 or 96 is aligned with the opening 86. The entire assembly 76 is then ready for use in the manner described above. Upon projection of the syringe the sharpened end 40 of needle 24 enters the animal's skin, shifting sleeve 30 rearwardly. This opens the aperture 46, causing plunger 88 to be shifted forwardly under the influence of compressed spring 102, in order to thereby inject the dose into the animal.

Another embodiment of the invention is illustrated in FIGS. 11–17, in the form of syringe assembly 104. The latter includes a tubular syringe body 106 having a reduced diameter open injection end 108 together with an opposed plunger end 110. A plunger 112 is located within body 106 and presents peripheral sealing ribs 114, a forward injection face 116, and a rearmost face 118. The face 118 is provided with an upstanding, hollow housing 120 whose upper wall 122 has a somewhat T-shaped opening 124 therethrough.

A plunger rod 126 also forms a part of the assembly 104, with rod 26 including an uppermost cap 128. The inner or lower end of the rod 126 is in the form of a T-shaped locking element 130 which is sized to pass through opening 124 and be situated within the confines of housing 120.

The assembly 104 further includes end cap 132 having a threaded shank 134 adapted to mate with corresponding threading provided adjacent end 110 of syringe body 106. Cap 132 has a bore 136 therethrough terminating in a resilient valve 138 of the type typically used for the filling of footballs or basketballs.

Finally, the syringe assembly 104 has the specialized injection needle 24 described in detail above, together with the slidable elastomeric sleeve 30.

The use of syringe assembly 104 proceeds as follows. First, a hypodermic needle of conventional construction is placed on end 108 of body 106, and this needle is inserted into a vial 140 of medicament. The rod 126, having locking element 130 within housing 120 and out of alignment with opening 124, is used to withdraw plunger 112, thereby drawing liquid medicament into body 106. At this point the filled syringe body is placed in an inverted position, and the hypodermic needle removed. The specialized needle 24 is then placed on end 108, with the sleeve 30 in its flow-blocking position. The rod 126 is then rotated so that element 130 aligns with opening 124 whereupon the rod is completely removed from housing 120 and withdrawn from the open rearward end of body 106. The end cap 132 is then threaded into the rearward end 110 of the body 106, in order to achieve a fluid tight connection. The needle 142 of a conventional air filled syringe is then pushed through the flexible valve 138 in order to inject pressurized air into the region of body 106 between face 118 of plunger 112 and cap 134. Inasmuch as the sleeve 30 is in place over the opening 46, however, such pressurized air does not move plunger 112 towards end 108.

The use of assembly 104 in its filled condition is identical with the embodiments described previously. Here again, when the specialized needle 24 penetrates an animal's skin the sleeve 30 is shifted rearwardly, opening aperture 46. Plunger 112 is then shifted toward injection end 108 under the influence of the biasing force created by the pressurized air above the plunger as described. This of course serves to inject the dose into the animal.

We claim:

1. A projectible syringe for introduction of a fluid substance into a subject from a position remote from the subject, said projectible syringe comprising:

a tubular syringe body for holding a dose of said fluid substance and presenting an elongated sidewall, an open injection end, and an opposed plunger end;

means for drawing said dose into said syringe body, maintaining the dose within the body during projection of said syringe, and for injection of the dose into the subject, including an elongated injection needle affixable to the open injection end of said body and having a sharpened, skin-piercing end remote from said body injection end, a trasversely extending injection aperture along the length of the needle and spaced from said skin-piercing end, and an axial fluid passageway communicating said aperture and the open injection end of said syringe body;

a plunger within said tubular body having peripheral fluid sealing means engaging said body sidewall and being axially shiftable along the length of the tubular body, said plunger presenting a pair of opposed faces respectively adjacent to and remote from said injection end of said syringe body;

an elongated plunger rod operatively coupled with said plunger and extending out the plunger end of said tubular syringe body for permitting selective withdrawal of the plunger therewithin in order to draw said dose of substance into the syringe body;

means for selectively restraining said forward plunger movement to thereby maintain said dose within the syringe body during projection of the syringe, including a shiftable fluid flow-blocking member positionable in covering relationship over said needle aperture and being shiftable away from said aperture upon encountering the skin of said subject, whereby said aperture is opened; and means for creating a biasing force against the face of said plunger remote from said injection end for forwards movement of the plunger towards said injection end to inject said dose, said biasing force being sufficient to move said plunger forwardly within the syringe body to inject said dose into the subject, upon said shifting of said blocking member away from said needle aperture.

2. The syringe of claim 1, said force-creating means comprising a secondary rod operatively coupled and shiftable with said plunger rod, means defining a secondary vacuum chamber receiving said secondary rod, and sealing means carried by said rod for sealingly engaging the inner wall surfaces of said secondary chamber.

3. The syringe of claim 2, there being a pair of said secondary rods and a pair of corresponding secondary chambers receiving the same.

4. The syringe of claim 2, said secondary chamber being formed in said sidewall of said tubular syringe body.

5. The syringe of claim 1, said force-creating maans comprising spring means within said tubular syringe body and engaging the face of said plunger remote from said injection end, said spring means being compressible upon withdrawal of said plunger during filling of said syringe body.

6. The syringe of claim 1, said force-creating means comprising means closing said plunger end of said syringe body, and valve means carried by said plunger end closing means for permitting introduction of pressurized air into said syringe body between said plunger and said plunger end closing means.

7. The syringe of claim 1, said restraining means comprising mechanical latching means for holding said plunger in a retracted position.

8. The syringe of claim 7, said latching means including a plurality of axially spaced apart detents on said plunger rod, and shiftable locking means alternately engageable with said detents.

9. The syringe of claim 7, wherein said latching means comprises an apertured end cap adjacent to the plunger end of said syringe body and presenting a non-circular opening therethrough, said plunger rod having a plurality of elongated, axially extending sections of cross sectional shape corresponding to said non-circular opening and separated by rod zones rotatable within said non-circular opening, whereby said plunger rod can be withdrawn to a point wherein one of said zones is adjacent the end cap and said plunger rod can be pivotally rotated until the adjacent rod section is out of alignment with said non-circular opening.

10. The syringe of claim 1, including means detachably coupling said plunger rod to said plunger.

11. The syringe of claim 1, said blocking member comprising an elongated, resilient, flow-blocking sleeve slidable along the length of said injection needle.

* * * * *